US007882973B2

(12) United States Patent
Krohn

(10) Patent No.: US 7,882,973 B2
(45) Date of Patent: Feb. 8, 2011

(54) PORTABLE CONTAINER WITH INTEGRAL FOLDING MECHANISM

(76) Inventor: Christopher G. Krohn, 3424 Hubbs Crossing La., Knoxville, TN (US) 37938

( * ) Notice: Subject to any disclaimer, the term of this patent is extended or adjusted under 35 U.S.C. 154(b) by 354 days.

(21) Appl. No.: 12/220,935

(22) Filed: Jul. 30, 2008

(65) Prior Publication Data

US 2010/0025397 A1 Feb. 4, 2010

(51) Int. Cl.

| | |
|---|---|
| ***B65D 6/00*** | (2006.01) |
| ***B65D 88/00*** | (2006.01) |
| ***B65D 8/04*** | (2006.01) |
| ***B65D 8/18*** | (2006.01) |

(52) U.S. Cl. ..... 220/1.5; 220/6; 220/666; 220/720; 52/79.5; 52/66

(58) Field of Classification Search ..... 220/1.5, 220/6, 666, 720; 52/64, 66, 79.5, 143
See application file for complete search history.

(56) References Cited

U.S. PATENT DOCUMENTS

| | | | | |
|---|---|---|---|---|
| 844,955 | A * | 2/1907 | Morgan | 220/8 |
| 3,612,330 | A * | 10/1971 | Baer | 220/1.5 |
| 3,865,269 | A * | 2/1975 | Coleman | 220/6 |
| 4,577,772 | A * | 3/1986 | Bigliardi | 220/1.5 |
| 4,684,034 | A | 8/1987 | Ono et al. | |
| 4,848,618 | A * | 7/1989 | Yuan et al. | 220/1.5 |
| 2007/0108204 | A1 | 5/2007 | Warhurst et al. | |
| 2008/0135545 | A1 * | 6/2008 | Sadkin et al. | 220/1.5 |

* cited by examiner

*Primary Examiner*—Anthony Stashick
*Assistant Examiner*—Madison L Wright

(57) ABSTRACT

A foldable portable container provided with an integral mechanical mechanism for folding or unfolding the container is described. The integral mechanical drive mechanism is utilized to simultaneously angularly displace the opposing container end walls and the container roof attached thereto to fold or unfold the portable container.

20 Claims, 6 Drawing Sheets

PORTABLE CONTAINER WITH INTEGRAL FOLDING MECHANISM

BACKGROUND OF THE INVENTION

The present invention is directed generally to portable containers useful for the shipping and/or storage of goods and materials and for field housing applications, and more particularly to such containers which are foldable and which are provided with an integral mechanical mechanism for effecting the folding and unfolding of the containers without the assistance of external lifting equipment.

The efficiency and costs associated with the moving, shipping and/or storage of various goods and materials has been greatly improved through the use portable containers that can be easily transported to different locations by a suitable carrier such as a truck, rail, or ship. These portable containers are provided in a wide range of sizes varying from relatively small volume containers that are particularly suitable for storage and moving applications and usually transported by truck to larger volume containers suitable for transport of goods and materials by rail or shipping lines.

One shortcoming found to be present with previously known portable containers is that these containers whether empty or filled require the same space for transportation and storage purposes. This problem has been addressed by utilizing foldable containers which can be shipped and stored in a folded state and then unfolded for receiving storable goods and subsequent storage or shipping and storage of the loaded containers. Such a foldable container which when folded occupies a significantly smaller volume than when in an unfolded state has been provided by Peter S. Warhurst et al as shown and described in United States Patent Application Publication, No. US 2007/0108204 A1, published May 17, 2007. Another such foldable container is described by Ono et al in U.S. Pat. No. 4,684,034, issued Aug. 4, 1987. The publication and the patent are each directed to foldable portable containers having foldable end walls pivotally attached to either the floor or the roof and sidewalls pivotally attached to both the roof and floor folded in the middle to fold the container. In a container folding operation, the end walls are initially pivotally folded and then the side walls with the attached roof are folded inwardly to provide a folded container of a significantly reduced volume. The empty containers are unfolded by simply reversing the folding operation. Inasmuch as the side walls and the attached roof of such known portable containers are cumbersome and relatively heavy for manually handling, a lifting mechanism such as provided by a fork lift or crane is necessary to support, lower and lift the roof and side walls during both the container folding and unfolding operations.

SUMMARY OF THE INVENTION

The present invention is directed to foldable portable containers useful for the storage and/or shipping of goods and materials as well as such containers that are configured for field applications such as housing or medical use. The foldable containers can be transported in a folded state to the selected point of use by utilizing any suitable transportation means such as provided by presently known trucking, rail, air, and shipping lines. Once at the selected point of use a container is readily unfolded by employing a mechanical container folding/unfolding mechanism that is an integral part of the container. Likewise, an empty unfolded container can be folded into a compact shipping unit by employing the onboard or integral container folding/unfolding mechanism.

In the practice of the present invention, the folding and unfolding of the portable containers is easily accomplished without employing an external lifting device such as a crane or like as required for the folding or unfolding of previously known containers such as described above.

Generally, the portable foldable container of the present invention comprises elongated rectangle base means and roof means oriented in planes substantially parallel to and vertically spaced from one another. First and second elongated opposing and vertically oriented side wall means are disposed between the base means and the roof means. First and second elongated vertically oriented and opposing end wall means are disposed between the base means and the roof means and are oriented in vertical planes substantially perpendicular to and at the ends of the first and second side wall means. Hinge means connect an end section of each of the first and the second side wall means to the base means for the pivotable or angular displacement of the each side wall means sequentially towards the base means during the container folding operation and into locations adjacent to and overlying the base means. Further hinge means connect an end section of each of the first and second end wall means to the base means for providing rotational axes for the pivotal or angular displacement of the first and second end wall means towards one another during such container folding operations. Movable connecting means are coupled to each of the first and second end wall means and coupled to the roof means in a relatively movable manner the so that first and second end wall means and the connected roof means can be simultaneously displaced in a first direction inwardly towards the base means and into substantially parallel locations overlying and adjacent to the first and second side wall means during container folding. Reversible drive means are supported by the roof means and are connected to each of said first and second end wall means for displacing the movable connecting means and thereby providing the simultaneous displacement of the first and second end wall means in the first direction.

The reversible drive means also displace the movable connecting means during container unfolding in a second direction opposite to the aforementioned first direction to simultaneously displace the first and second end wall means away from the substantially parallel locations overlying the base means for positioning the first and second end wall means in the aforementioned vertical orientation and the roof means in the plane vertically spaced from the base means.

Stabilizing means are preferably utilized to help maintain the roof in a horizontal plane substantially parallel to the base means during the simultaneous displacement of the end wall means and the connected roof means so as to substantially minimize or obviate objectionable binding at the hinges and other relatively movable components. Also, roof lifting means positionable at one or more locations intermediate the roof means and the base means can be used to instigate or substantially assist in the initial vertical displacement of the roof means during container unfolding. The roof lifting means in the form of cantilevered leaf spring means are loaded or biased for the roof-lifting function by the reversible drive means during the final stages of the container folding operation. The reversible drive means maintains the load on the leaf spring means when the container is in a folded condition. Additionally, coil spring means are positionable to be loaded or compressed by the reversible drive means during the final stages of the container folding operation. During the unfolding of the container the stored energy in the compressed coil springs significantly assists the reversible drive means in the initial displacement of the first and second end wall means in the second direction.

By utilizing this combination of features, portable containers can be readily transported to the desired point of use in a folded state then unfolded to form structurally sound containers by simply employing the integral mechanical container folding and unfolding mechanism of the present invention. Also, empty unfolded containers located at various locations including highly remote sites may be readily collapsed or folded into a relatively small shipping package by reversing the integral container folding and unfolding mechanism. In the present invention, a simple hand held ratcheting wrench or a standard pneumatic or battery-powered screw or impact driver, preferably a high torque and high speed rotary device such as D.C. automobile starter motor or similar high torque rotary driver, is all that is needed to displace the movable connecting means in the selected direction for effecting the required pivoting of the first and second end wall means needed for the folding or unfolding the container.

A significant feature of the present invention is that the folding and unfolding of the portable containers is achieved without utilizing an external lifting mechanism such as a fork lift or crane as previously required for the folding or unfolding of previously known foldable containers such as described above. By being able to so fold and unfold the containers in the field, the manpower and equipment requirements for such purposes are significantly less than previously required so as to substantially increase the desirability and practicality of the containers of the present invention.

Other and further features of the present invention will become obvious upon an understanding of the illustrative embodiments about to be described or will be indicated in the appended claims, and various advantages not referred to herein will occur to one skilled in the art upon employment of the invention in practice.

DESCRIPTION OF THE PREFERRED EMBODIMENT

Figure 9:
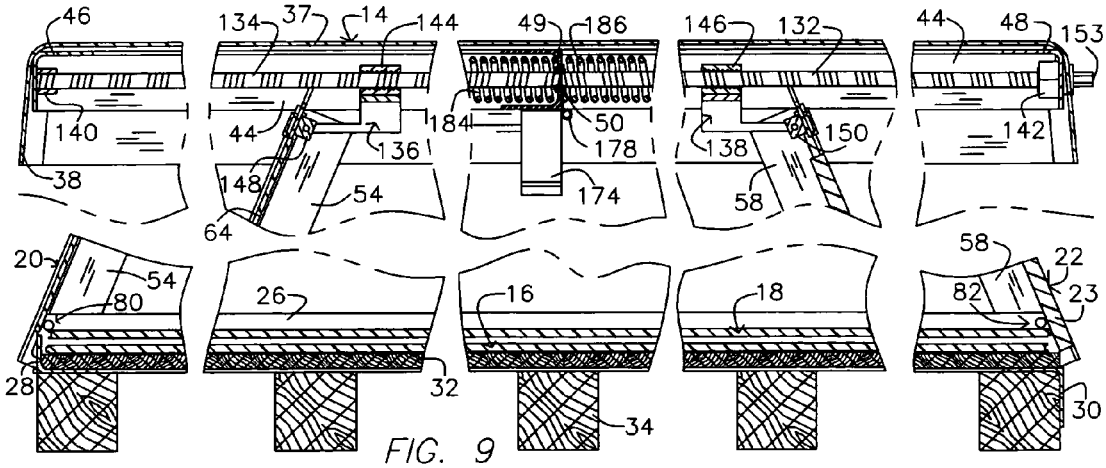
FIG. 9 is perspective view generally taken along line 9-9 of FIG. 4, partially broken away, showing details of the folding and unfolding mechanism and the position of such with the container in a partially folded state.
Figure 10:
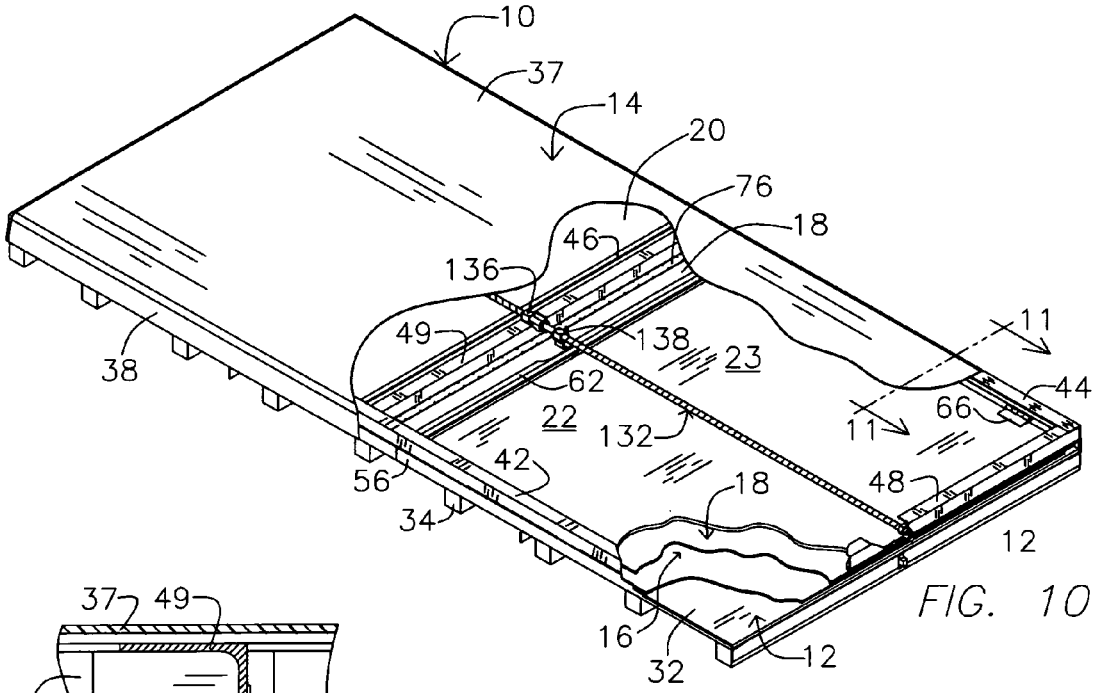
FIG. 10 is a perspective view of the container of FIG. 1 showing the container fully folded.

With reference to FIGS. 1-13 of the drawings, a preferred embodiment of the foldable container 10 is shown in an assembled or unfolded state for providing an enclosable space or volume satisfactory for the storage of goods and materials and the transportation of such contained goods and materials. The container 10 is of a rectangular configuration and is of any dimension desired for the particular intended purpose and which is suitable for transportation by a common carrier such as truck, rail, air or ship. For example, a container with unfolded dimensions of 8'×8'×16' is of a sufficient size suitable for such shipment and for use in most storage and transportation applications as well as for other uses such as field applications requiring a readily portable and erectable contained space for living quarters, field offices, laboratories or field medical facilities. In the present invention the length of the container is at least substantially twice the height of the contained volume so as to assure the top ends of the end walls will be in a nearly abutting parallel position when the container is folded as shown in FIG. 10. For the purpose of this description and since some components are structurally and functionally similar to one another, suchcomponents where practical will be given the same identifying numeral plus a lower-case letter.

As best shown in FIGS. 1-4, the container 10 is generally defined by a horizontally extending rectangular floor 12, a horizontally extending rectangular roof 14 which is positioned in a plane parallel to and vertically separated from the floor 12. This positional relationship of the floor and roof is provided by vertically extending and horizontally spaced-apart side walls 16 and 18 and vertically extending and horizontally spaced apart end walls 20 and 22. End wall 22 is shown provided with a lockable double door assembly 23 for controlled access into the container 10.

More specifically, the floor 12 of the container 10 has a rectangular frame formed of elongated angle-iron railings 24, 26, 28 and 30 (FIG. 2) that are joined together at the ends thereof in any suitable manner such as by welding or the like. The floor railings 24 and 26 are positioned on opposite sides of the floor 12 with upwardly extending flanges positioned adjacent to outermost edges of the floor 12. The floor railing 28 at the end of the container 10 opposite the door 23 is similarly positioned but with the upwardly extending flange being slightly inset from the edge of the floor 12, the purpose of which will be explained below. The angle-iron railing 30 at the door end of the container 10 is positioned with one flange extending downwardly at outer edge of the floor 12 to permit easy ingress and egress into and from the contained volume 31 within the container 10.

The floor 12 includes a deck 32 formed of side-by-side panels of wood or any other suitable material. These floor panels are supported at the ends thereof on the horizontally inwardly extending flanges of by the angle-iron railings 24, 26, 28 and 30. The deck panels may be attached to these angle-iron flanges in any suitable manner such a by screws, bolts or the like. The floor 12 is shown supported by plurality of horizontally spaced-apart wooden beams 34 underlying deck and the angle-iron railings. The floor 12 can also be provided with additional structural support such as provided by metal cross members 35 positioned between the wooden beams 34.

Figure 11:
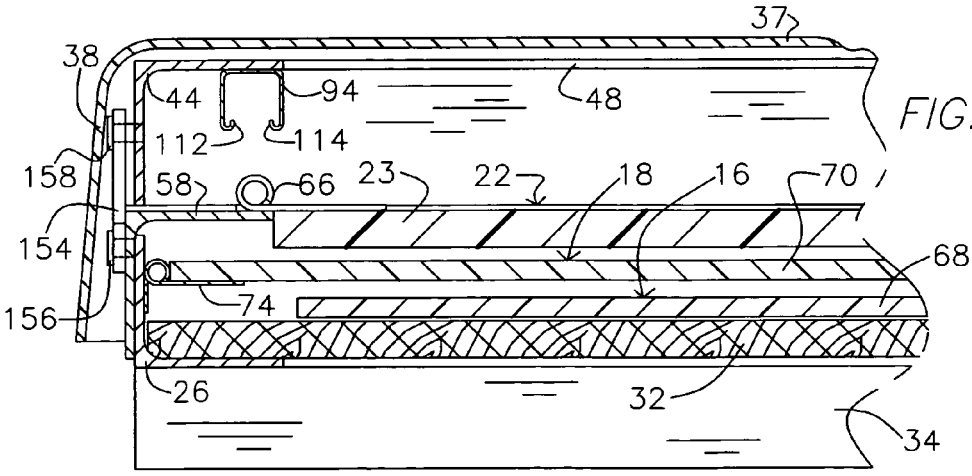
FIG. 11 is a fragmentary sectional view taken along lines 11-11 of FIG. 10 showing the positional relationship of container components when the container is in a folded state.

The roof 14 of the container 10 is provided by a rectangular cap 37 formed of any suitable material such sheet metal, fiberglass or of a thermoformed plastic. The roof cap 37 is preferably provided with downwardly extending side regions or eaves 38 which are shown disposed at an outwardly oriented angle with respect to the vertical plane. Thus, when the container 10 is in a folded state as shown in FIGS. 10 and 11 the eaves 38 overhang and cover the underlying container components. In the present invention the roof cap 37 is provided with a rectangular framework 40 that is positioned under the cap adjacent to the eaves 38. The framework 40 is shown formed of elongated angle-iron sections 42, 44, 46 and 48 which are attached together at the ends thereof by welding or the like and to the roof cap 37 by any suitable means such as screws or bolts (not shown). These angle-iron sections are positioned so that the upper surface regions of the framework 40 is defined by horizontally inwardly extending flange portions of the angle iron sections while the peripheral edge regions of the framework 40 is defined by the vertically downwardly extending flange portions of the angle iron sections. The roof framework 40 also includes a centrally positioned metal c-channel brace 49 which extends between the side wall sections 42 and 44 for providing additional support for the cap 37 as well as supporting cantilevered leaf spring means available for initial roof-lifting purposes and a bearing assembly 50 for the self contained or integral container folding and unfolding mechanism, as will be described below. The structural integrity of the roof 14 may be enhanced by providing the roof cap 37 with any desirable strength increasing array of ribs or other reinforcing shapes during or subsequent to the formation thereof.

Figure 2:
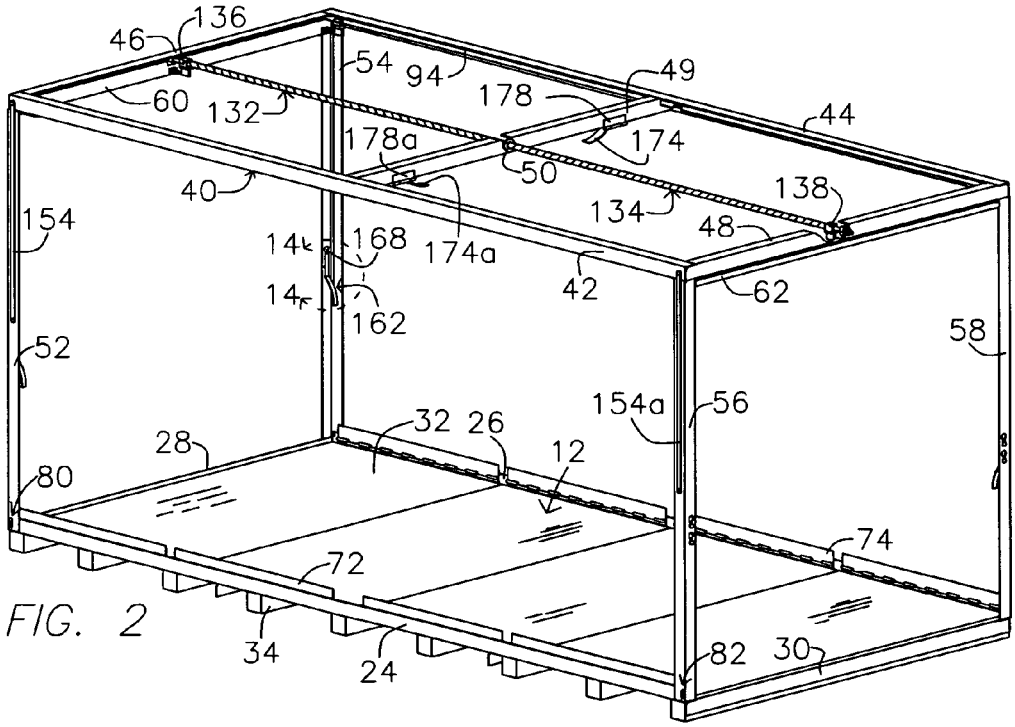
FIG. 2 is a skeletal perspective view of the FIG. 1 embodiment illustrating the container framework.

The roof is supported by four angle iron columns 52, 54, 56 and 58 that are positioned at the corners of the container 10 and vertically extend between the floor railings 24, 26, 28, and 30 and the angle iron sections 42, 44, 46 and 48 of the roof framework 40. The vertical columns can be of any length depending on the interior height desired of the container and are of a sufficient dimension and thickness needed to provide the container with the structural integrity required for the envisioned uses of the container 10. Angle iron columns with dimensions of 3"×3"×3/16" should provide a container 10 of the aforementioned exemplary dimensions with sufficient structural strength for most applications. The angle iron used for the floor railing 28 is preferably 3"×2"×3/16" with the vertically extending flange of railing 28 being 2 inches in height for reasons explained below. These columns 52, 54, 56 and 58 are each positioned so that the apex connecting the right angle flanges of these angle iron columns defines the vertical corners of the container 10. The flanges of each of these vertical columns project towards the vertical flanges of adjacent columns as shown in FIG. 2.

Metal crossbars 60 and 62 in the form of rectangular plates are horizontally positioned and extend between the upper ends of the facing flanges of vertical columns 52 and 54 and columns 56 and 58 respectively. These cross bars 60 and 62 are securely connected at the ends thereof to the flanges of the columns at the uppermost ends thereof by welding, bolting or any other suitable fastening means. These cross bars 60 and 62 are connected to and so positioned on the columns so that the opposite ends or surface regions thereof will nest within the uppermost end regions of the vertical column flanges and be positioned adjacent to the inside surface of the vertically projecting flanges of roof framework sections 46 and 48.

The vertical columns and the attached cross bars form the framework of the end walls 20 and 22. The end wall 20 is completed by placing one or more panels 64 within the framework defined by flanges of columns 52 and 54 and the lower end region of cross bar 60 and affixing these panels 64 to this framework in any suitable manner such as by employing easily removable cam locks, screws or the like. End wall 22 is completed by attaching the side panels of the double door 23 to the flanges of columns 56 and 58 with suitable hinges such as shown at 66 in FIGS. 1, 3, 4, and 11. While the door 23 is shown as a double door, it will appear clear that any suitable door arrangement can be used such as a single door 67 as shown in FIG. 12.

Figure 1:
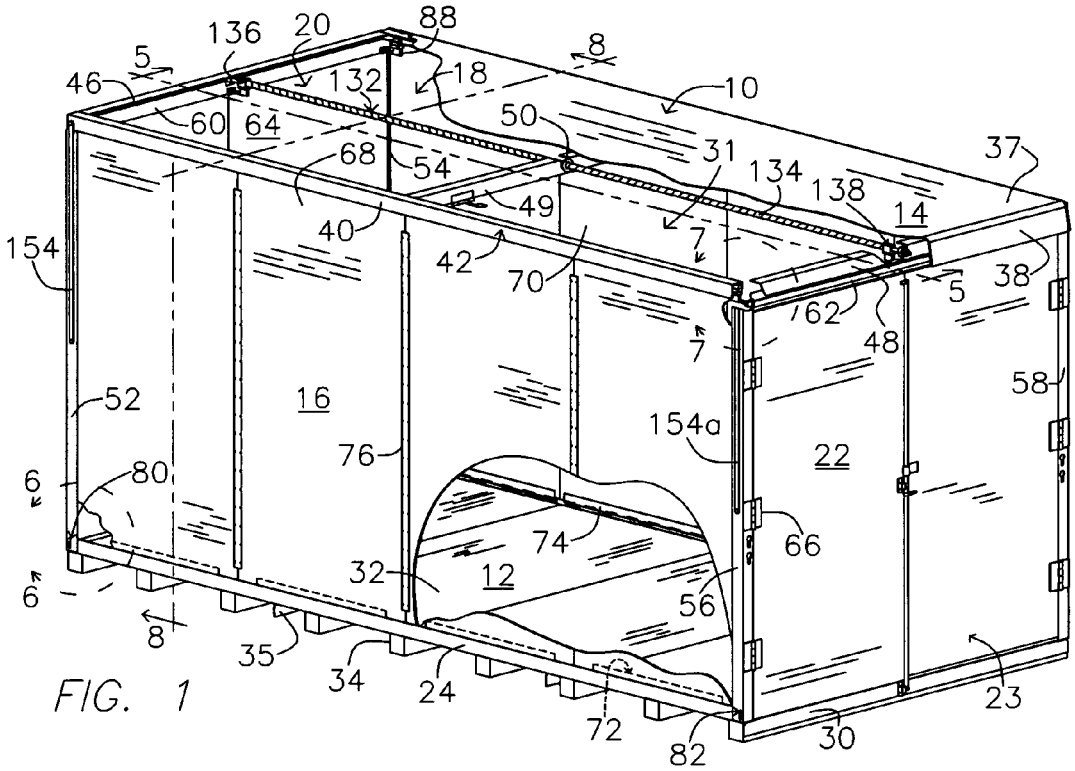
FIG. 1 is a perspective view of a preferred embodiment of the foldable portable container of the present invention with portions of the container broken away for illustrating details of the integral mechanical mechanism utilized for folding and unfolding the container.
Figure 3:
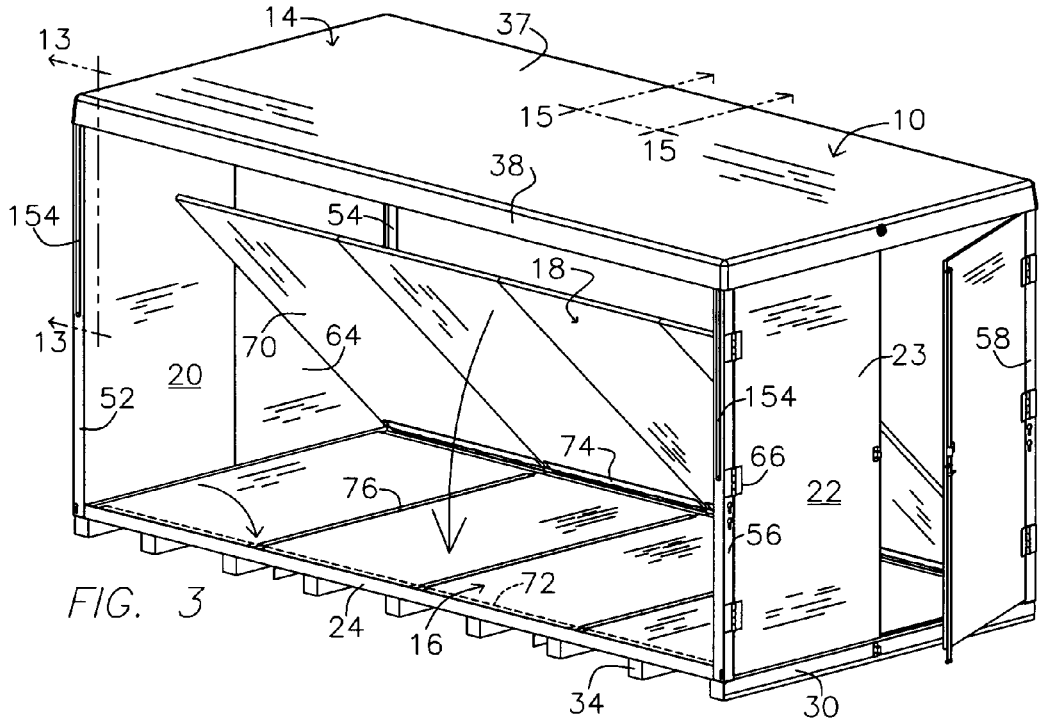
FIG. 3 is a perspective view of the FIG. 1 embodiment showing the container partially folded.
Figure 12:
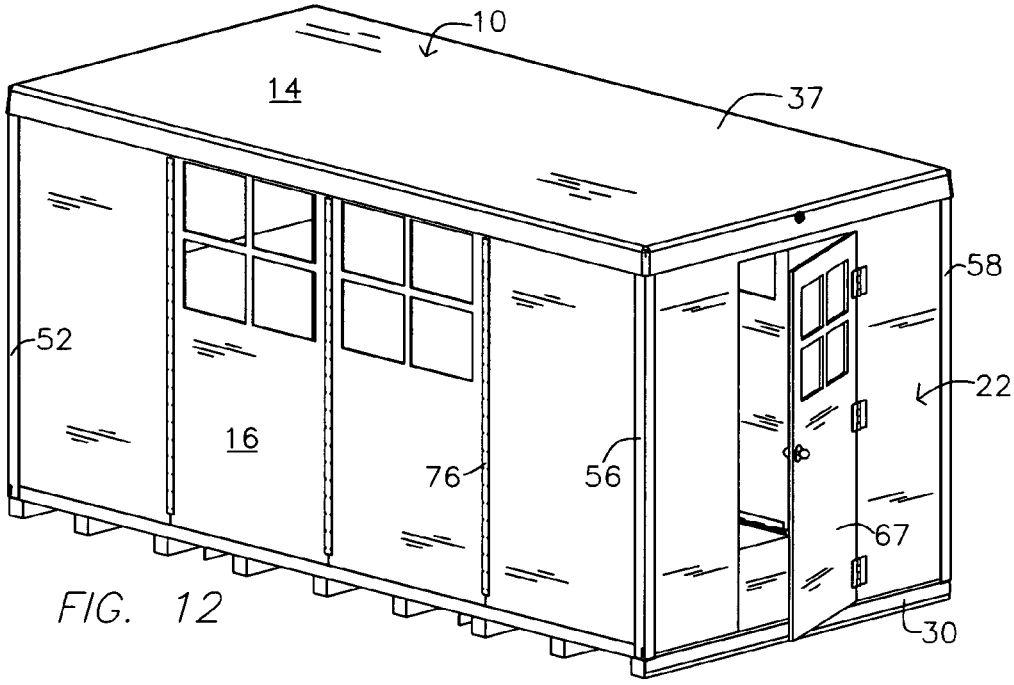
FIG. 12 is a perspective view of the container of the present invention illustrating the container with modular wall panels.
Figure 13:
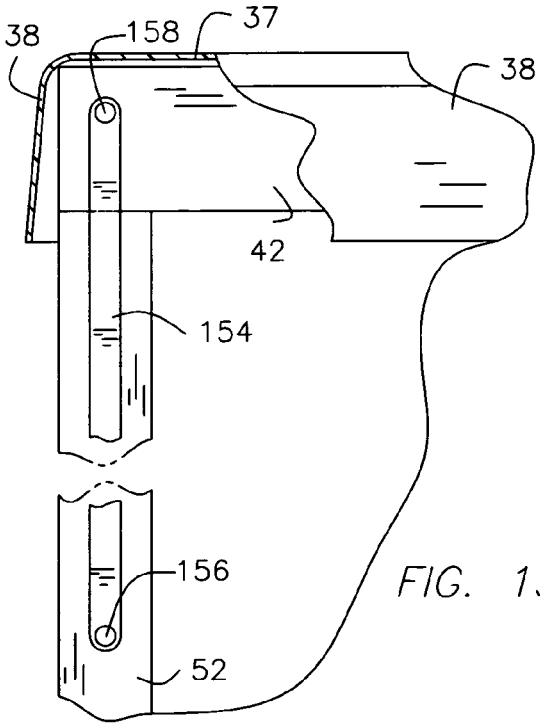
FIG. 13 is a fragmentary sectional view taken along lines 13-13 of FIG. 3 showing details of one of the four elongated stabilizing arm assemblies used for maintaining the roof assembly in a plane parallel to the container base during vertical displacements thereof.

In the present invention the side walls 16 and 18 can be formed of one or more rectangular wall panels 68 and 70 (four such side wall panels are shown FIGS. 1, 3 and 12 for each side wall 16 and 18). These side wall panels 68 and 70 may be formed of any suitable material such as wood, plastic, metal, composite materials or any combination thereof. When using a multiple number of panels to form the side walls 16 and 18, the panels can be connected together by employing any suitable fastening mechanism such as screws, latches, cam locks, or screw-on strips as generally shown at 76 or any other mechanism which will provide a secure connection. Preferably, the connecting mechanism for connecting the panels together are of the type which can be readily engaged or disengaged in order to facilitate changing the panel arrangement as would be desired for containers having modular capabilities for permitting the use of different items such as the windows and a single door as shown in FIG. 12.

These wall panels 68 and 70 are placed in a side-by-side relationship and are attached to inside surface of the vertical flanges of side floor railings 24 and 26 by suitable hinge means 72 and 74. These side wall panels are also positioned on the inside surface of the vertical flange of the roof framework sections 42 and 44. The tops and the open end portions of these joined-together side wall panels are also securely fastened to the inside of vertical flanges of the roof framework sections 42 and 44 and the inside of the side-facing flanges of the vertical columns 52, 54, 56, and 58 by secure but readily removable connecting means such as cam locks, spring-loaded clips, latches, or screws as generally shown at 78 in FIG. 8. The secure fastening of the side-wall panels to the flanges on the roof framework and on the vertical columns increases the structural integrity of the container and helps assure air-tightness of the container. Suitable weather stripping is preferably used between joints of the side-wall and end wall components as well as in any other joint area of the container where the use of weather stripping would be desirable to provide a weather tight structure.

Figure 8:
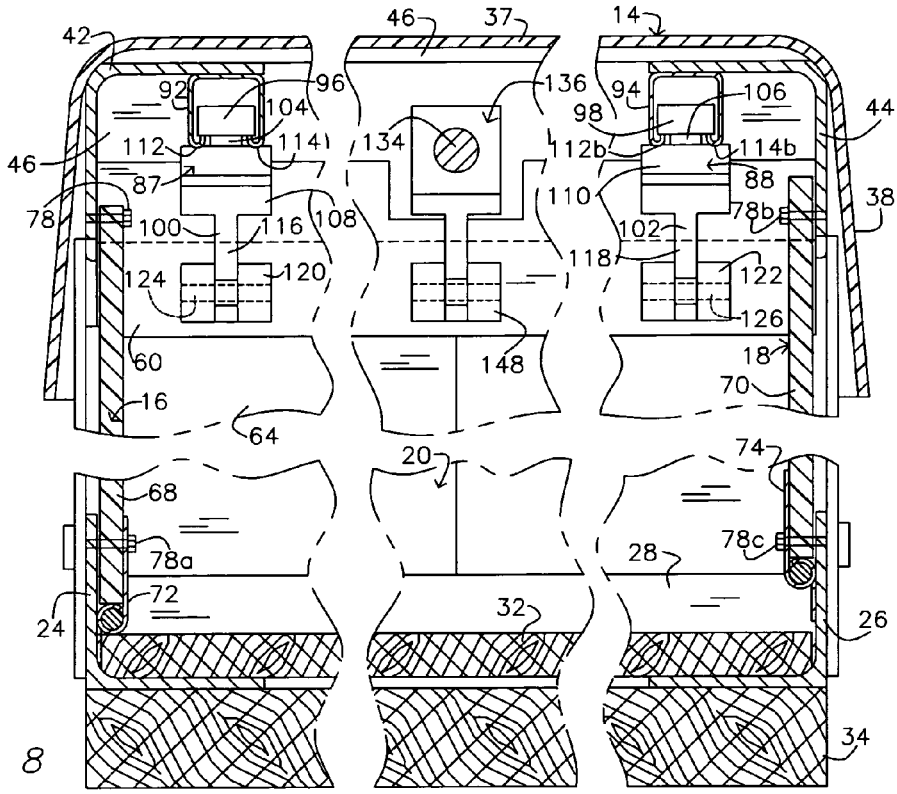
FIG. 8 is transverse vertical cross-sectional view taken along line 8-8 of FIG. 1 showing positions and details of the container folding and unfolding mechanism and the container sidewalls.

The hinges 72 and 74 connecting the side-wall panels 68 and 70 to the upright flanges of the side floor railings 24 and 26 are of any suitable type which is of sufficient strength to maintain the panels in the selected position and which will provide an axis of rotation or pivot axis for the panels. Piano hinges, as shown, are satisfactory for this purpose but other types of hinges such as butt hinges or slip joint hinges may be used. The wall panels 68 and 70 can be attached to the hinges in any suitable manner such as by screws or the like. Also, hinge halves may be attached to the wall panels 68 and 70 and the hinge halves joined together during the installation of the wall panels. As shown in FIG. 8 the hinge 74 is positioned on the flange of the floor railing 26 at location higher than the position of hinge 72 on the flange of floor railing 24 so that the side walls 16 and 18 can be sequentially folded into a stacked, parallel relationship on the deck 32 of the container floor 12 (FIGS. 10 and 11).

For the purpose of folding the side walls 16 and 18 into container 12, the fasteners 78 attaching the panels 68 and 70 to the vertical flanges on the roof framework and the flanges on the vertical columns are disengaged or removed and these panels are then manually folded in a sequential manner (panel 68 first and then panel 70) about the hinge couplings 72 and 74 into the stacked horizontal positions overlying the floor 12. These side wall panels 68 and 70 are shown partially folded in FIG. 3 and completely folded as shown in FIGS. 9, 10 and 11. When unfolding the side walls 16 and 18 of a folded container these folding steps are reversed.

Figure 6:
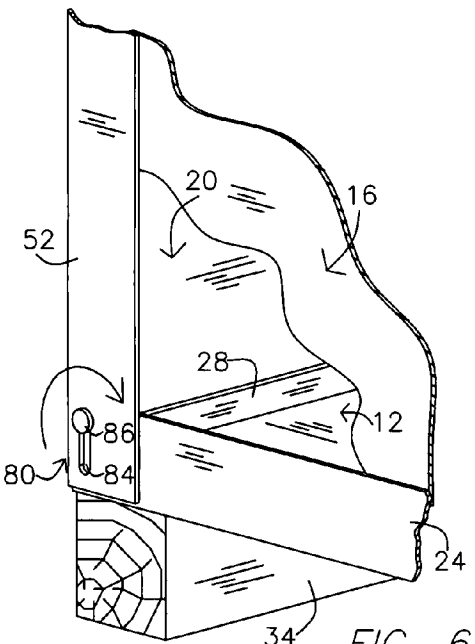
FIG. 6 is a fragmentary view taken along lines 6-6 of FIG. 1 showing details of the hinging arrangement used for the folding and unfolding of the container end walls.

As best shown in FIG. 6, the lower ends of the flanges on the vertical columns 52 and 54 are connected in a relatively movable manner by hinge means 80 to the end portions of the adjacent vertical flanges of the side floor railings 24 and 26. Similarly, the lower ends of the flanges on the vertical columns 56 and 58 are connected in a relatively movable manner by hinge means 82 to the end portions of the adjacent and inwardly facing vertical flanges at the door end of the side floor railings 24 and 26. These hinge means provide a rotational or pivot axis about which the joined together vertical columns 52 and 54 of end wall 20 and columns 56 and 58 of end wall 22 can be simultaneously pivoted or angularly displaced towards one another within the container 10 and into substantially horizontal end-to-end positions upon completely folding the container as shown in FIG. 10. Conversely, when the folded container is unfolded, the end walls 20 and 22 are pivoted about the rotational axes afforded by the hinge means 80 and 82 and angularly upwardly displaced away form the horizontal positions of FIG. 10 and into the upright positions required of the assembled container as in FIG. 1.

The lower end of the end wall 20 is positioned against the outside surface of the vertical flange floor railing 28 for enhancing the structural integrity of the unfolded container. For this purpose, the floor railing 28 is positioned sufficiently inwardly from the end of the floor so as to position the vertical flange of floor railing 28 inside of the end wall 20 a distance substantially corresponding to the thickness of the end wall 20.

A hinge mechanism about which end panels 20 and 22 can be satisfactorily pivoted as well as lifted in accordance with the requirements of the present invention is achieved by using a pin and slot arrangement as best illustrated in FIG. 6. This hinge arrangement is provided by placing a vertically extending through-going slot 84 in the lower end region of each side-facing flange on each of the four vertical columns 52, 54, 56 and 58. The end portions of the vertical flanges of the floor railings 24 and 26, are, in turn, each provided with a horizontally outwardly extending round pin 86 which is positioned within an adjacent slot in the flange of an adjacent vertical column. When using this hinging arrangement the vertically extending flange on the floor railing 28 is of a height sufficiently less than the height of the vertical flanges on floor railings 24 and 26 so that the pins 86 projecting from the floor railings 24 and 26 can be positioned above and slightly inwardly from the top of the vertical flange on end floor railing 28.

The upward as well as the inward angular displacement of the end walls 20 and 22 provided by the hinging relationship of the pins 86 with the elongated slots 84 assures that the end wall 20 will be lifted sufficiently to be pivoted over the top of the flange of floor railing 28 when this end wall 20 is folded into desired horizontal positions during the container folding operation and returned to the vertical abutting relationship with the flange on railing 28 when the container is unfolded. Also, the elongated slots 84 allow the end walls 20 and 22 to be displaced or moved inwardly towards one another as the folding operation nears completion so that the lowermost ends of the end walls 20 and 22 do not extend beyond the ends of the container floor 12. This inward movement of end walls 20 and 22 near the completion of the folding operation assures that the eaves 38 on the roof cap 37 will overlap and cover the folded end walls as well as the folded side walls to provide a relatively weather tight and compact folded container package. To accomplished this desired vertical lifting of the end walls over the top of the floor railing 28 and the inward displacement of the nearly folded end walls, the elongated slots are preferably of a length slightly greater than the height of the vertical flange on floor railing 28 with the pins 86 positioned in the lowermost end of the slots 84 when the container is folded as in FIGS. 10 and 11. To accomplish this desired inward displacement of the folded end walls as shown in FIGS. 10 and 11, the elongated slots 84 need to be of a length sufficient to effect this inward displacement of the end walls with the pins 86 positioned in the lowermost section of the slots 84. Alternatively, the positioning of the pins 86 at a location on the vertical flanges of the side floor railings that would be engage a bore in the vertical columns near the outer edge of the flange of these columns would also provide for the desired lifting and inward displacement of the end walls during container folding.

While the preferred embodiment of foldable container 10 utilizes angle iron the construction of the floor railings, the vertical columns and the roof framework, it will appear clear that aluminum may be use in place of the steel in these components and that at least some of these structural components can be in the form of rectangular tubing, open-sided or c-channel iron, or any combination thereof including such combinations with angle iron.

The foldable container 10 of the present invention is provided with a self-contained or integral container folding and unfolding mechanism which enables the container to be folded or unfolded without the aid or an external lifting device as previously required of known foldable containers such as listed above. As best shown in FIGS. 1, 2 and 5-10, the integral container folding mechanism is a mechanical mechanism as will be described below which folds and unfolds the end walls 20 and 22 by utilizing movable connecting means 87 and 88 that join the cross bars 60 and 62 of the end walls 20 and 22 and to the roof framework 40. The movable connecting means 87 and 88 (four are used in this embodiment of the invention) are movable with respect to the roof 14 during the container folding and unfolding operations so as to vertically displace the attached roof 14 simultaneously with the folding and unfolding of the end walls 20 and 22.

Figure 7:
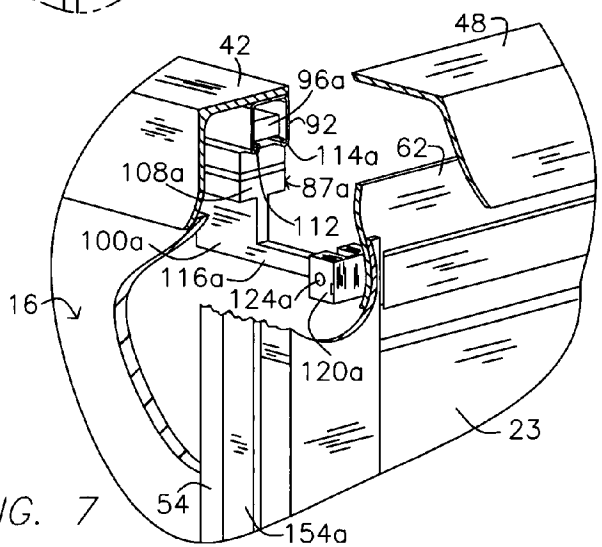
FIG. 7 is a fragmentary view taken along lines 7-7 of FIG. 1 showing the hinging and movable coupling arrangement utilized between the end walls and the roof of the container.

Movable connecting means 87 and 88 found to satisfactorily provide for the folding or unfolding of the end walls 20 and 22 along with the simultaneous displacement of the attached roof each include a hinge means which are coupled to and move or slide along slide means 92 and 94 attached to the roof. The slide means are provided by elongated U-shaped channel irons 92 and 94 that are attached at the base thereof to the lower surface of the horizontal flanges on the angle-iron side sections 42 and 44 of the roof framework 40. These channel irons 92 and 94 are parallel with one another and the sides of the container along the fold line for the end walls 20 and 22 and are of a length substantially corresponding to the spacing between the end walls 20 and 22. The opening into each of the channel irons 92 and 94 faces downwardly so as to receive therein round or rectangular end portions 96 and 98 of the movable hinge means or movable hinged slides 100 and 102. These end portions 96 and 98 comprise support blocks joined by relatively thin neck regions 104 and 106 to further round or rectangular portions or slide support blocks 108 and 110 that are positioned outside of U-shaped channel irons 92 and 94. As shown in FIGS. 7, 8 and 11, the openings into the channel irons 92 and 94 are provided with facing reentrant walls 112 and 114 which are at least substantially coextensive with the channel irons 92 and 94 and which are spaced from one another a distance sufficient to receive therebetween the neck portions 104 and 106 of the hinged slides 100 and 102. With this arrangement the slide support block 96 and 98 of the hinged slides 100 and 102 are positioned within the channel irons 92 and 94 and rest upon the top surface of the reentrant walls 112 and 114. The rectangular slide support blocks 108 and 110 are maintained sufficiently close to the underside surfaces of the reentrant walls 112 and 114 to assure that the hinged slides will not tip or otherwise hang-up as the hinged slides 100 and 102 are moved along support guides provided by the elongated channel irons 92 and 94. The upper and the lower surface of the reentrant walls provide bearing surfaces for the hinge support blocks 96, 98, 108 and 110. These hinge support blocks can be formed of steel but are preferably formed of a polymeric material such as polypropylene, polytetrafluoroethylene or the like so as to reduce sliding friction as the hinged slides are moved along the channel iron slides 92 and 94 during the container folding and unfolding operations. Also, it will appear clear that rollers or the like can be used in place of the sliding blocks of the hinged slides 100 and 102.

The hinging action of the hinged slides 100 and 102 is achieved by attaching horizontally extending arms 116 and 118 projecting from the slide blocks 108 and 110 of the hinged slides to the cross plates 60 and 62 of end walls 20 and 22 with a suitable hinge arrangement. A satisfactory hinge arrangement is a simple pivot hinge provided by attaching horizontally bored metal support blocks 120 and 122 to the cross plates 60 and 62 and then connecting the arms 116 and 118 to these hinge support blocks 120 and 122 by inserting dowels 124 and 126 in bores in the hinge support blocks and ends of the arms 116 and 118.

The folding of the container is achieved when the hinged slides 100 and 102 coupled to end wall 20 are displaced or moved towards simultaneously moving similar hinged slides (hinged slide 100*a* in FIG. 7) coupled to end wall 22 along the channel iron slides 92 and 94. This concurrent displacement of the four hinged slides simultaneously folds the end walls 20 and 22 and lowers the attached roof. Alternatively, unfolding a folded container is achieved by moving the hinged slides away from one another along the channel iron slides so as to simultaneously move the end walls 20 and 22 into vertical positions while raising the attached roof.

Figure 5:
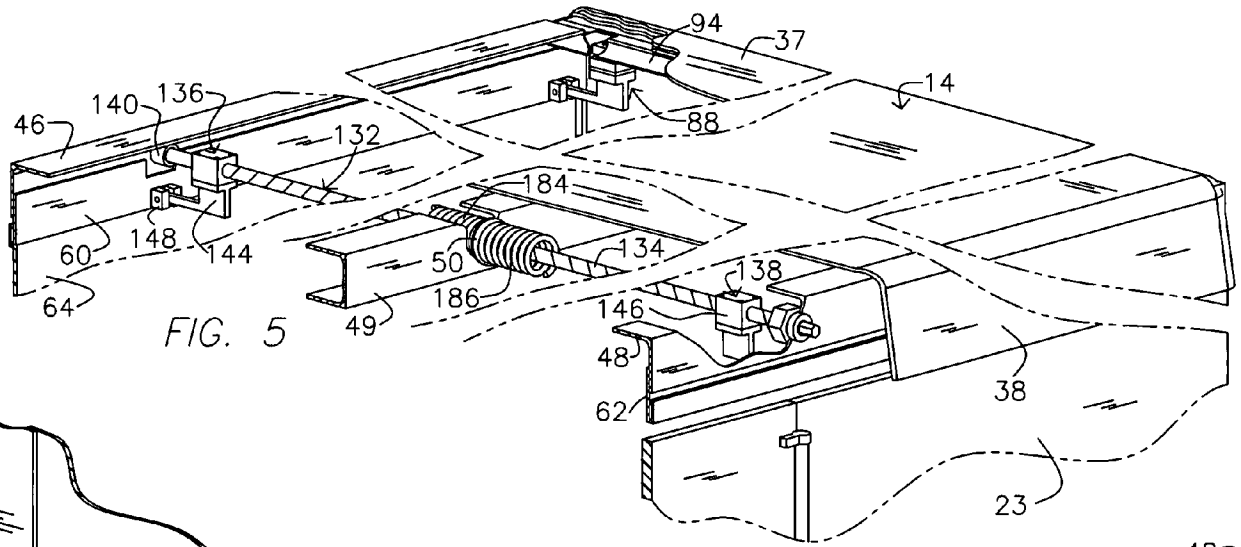
FIG. 5 is perspective view taken substantially along lines 5-5 of FIG. 1 and partially broken away for showing details of one of the four movable hinge means of the container folding and unfolding mechanism.

The folding and unfolding of the end walls 20 and 22 is achieved by utilizing the integral or self-contained and reversible linear motion drive mechanism of the present invention as generally shown at 132 in FIGS. 1, 2, 5 and 8-10. This linear motion drive mechanism found to be satisfactory for use in the present invention comprises an elongated threaded lead screw or worm gear 134 with oppositely threaded end sections carrying hinged traveling-nut assemblies 136 and 138 as best shown in FIGS. 5 and 9. The elongated worm gear 134 is positioned in the longitudinal center of the container 10 and extends between and is rotatably supported at the opposite ends thereof by the framework 40 in the container roof 14 by bearing mounts 140 and 142. These bearing mounts can be attached by welding or the like to the vertical flanges of the angle-iron sections 46 and 48 of the roof framework 40. This elongated worm gear 134 is also shown supported in a bearing assembly 50 mounted in the roof brace 49.

The traveling-nut assemblies 136 and 138 comprise internally threaded nuts 144 and 146 which are supported on and threadedly engage opposite end regions of the worm gear 134 and which are linearly displaced in opposite directions upon rotation of the worm gear 134. The threaded nuts 144 and 146 are connected to the cross plates 60 and 62 of end walls 20 and 22 by hinges 148 and 150. These hinges 148 and 150 may be satisfactorily constructed similarly to the hinge arrangement used for the hinged slides 100 and 102 described above. The oppositely threaded ends on the worm gear 134 are each of a length adequate to assure that the traveling-nut assemblies 136 and 138 will be sufficiently displaced thereon to effect complete folding and unfolding of the container end walls 20 and 22.

In order to rotate the worm gear 134 in either direction to effect the desired directional displacement of the traveling nut assemblies 136 and 138 for the selected folding or unfolding of the end walls 20 and 22, an end section of the worm gear at the door end 22 of the container projects through the bearing mount 142 and through a bore in the flange of section 48 of the roof framework 40. This end of the worm gear 134 is fitted with a nut-like appendage or structure 153 which can be readily engaged via a socket attached to a rotating drive mechanism (not shown) such as described above. The mechanical advantage afforded by the gear reduction relationship between the worm gear 134 and the threaded nuts 146 and 148 along with the torque afforded by well known electric and pneumatic rotary drivers is sufficient to the effect the desired folding and unfolding of the container 10 end walls 20 and 22 as described above without requiring any assistance from an external lifting device such as a crane or fork lift. Preferably, the particular rotary drive mechanism selected to rotate the lead screw 134 should have sufficient levels of torque and rotational speed to fold or unfold the end walls of the container 10 within a few minutes.

Stabilizing means may be used during the folding and unfolding of the container to assure that the end walls and the attached roof are substantially uniformly displaced toward and away from the base and thereby minimizing any binding or adverse loadings on the hinges or moving components. Satisfactory stabilization means such purposes may be achieved by affixing a scissoring assembly (not shown) at horizontally spaced apart locations on each of the vertical flanges of the roof framework sections 42 and 44 and to each of the vertical flanges of the floor railings 24 and 26. The folding and unfolding of this scissoring assembly is concurrent with the vertical displacement of the roof 14 and helps maintain the latter in a substantially horizontal plane parallel to the base 12 so as to help assure the uniform angular displacement of the end walls 20 and 22 and the vertical displacement of the roof 14. A scissor-like mechanism suitable for such stabilization purposes is generally shown in FIGS. 1-4 and more specifically in FIG. 13. This stabilizing mechanism comprises an elongated metal bar 154 movably affixed at the opposite ends thereof to each of the four vertical columns 52, 54, 56 and 58 and to the roof framework sections 42 an 44. As shown, the metal bars 154 are attached in a pivotal manner at one end thereof to the side-facings flanges of the vertical columns at common locations at essentially the midpoint thereof by capped pins or bolts 156. The opposite ends of the metal bars are similarly attached to the vertical flanges of the roof framework sections near the end thereof by capped pins or bolts 158. As shown the metal bars 154 are so attached to the roof framework that they lie in a plane parallel to the vertical column when the container 10 is unfolded. The attachments of each of the bars 154 to each of the vertical columns and the roof framework define axes about which the bars 154 can pivot or rotate during the simultaneous displacement of the end walls 20 and 22 and the roof 14 that occurs during the folding and unfolding of the container. As each stabilizing bar 154 is pivoted it provides and maintains a structural coupling between the end walls 20 and 22 and the roof 14 to assure that the roof 14 is maintained in a plane parallel to the base 12 during the vertical displacements thereof and that the ends walls and the attached roof will be uniformly displaced during container folding and unfolding operations. The stabilizing bars effectively negate or at least substantially minimize any binding at the hinges or couplings. Also, the effective length of each bar 154 is essentially one-half of the vertical height of each column 52, 54, 56 and 58 so as to assure that when the container is folded as in FIGS. 10 and 11 the bar will be readily oriented in a near horizontal plane along side of the folded columns (FIG. 11) without binding or hanging up In a container unfolding operation, as the reversible drive mechanism 132 initially moves the traveling nut assemblies 136 and 138 towards the ends of the container to pivot or angularly lift the end walls 20 and 22 and the roof 14 attached thereto, a substantial load or strain is placed on the drive mechanism 132. This load on the drive mechanism 132 can be substantially reduced by using roof lift assist means to assist the integral drive mechanism 132 in initially lifting the roof 14 and placing the end walls 20 and 22 on a slight incline during the initial stages of a container unfolding operation.

Roof lift assist means suitable for assisting in the initial lifting of the roof and the tilting or uplifting of the folded end walls 20 and 22 comprises a cantilever leaf spring assembly coupled to each vertical column 52, 54, 56 and 58 or to the roof brace 49. Each spring assembly has an elongated and curved leaf segment that is positionable between the upper surface of the folded side wall 18 and the folding columns or the descending roof prior to container folding so that contact is established between the springs and the side wall during final stages of container folding to place a roof-lifting bias or load upon each spring segment. This loading of these spring segments is provided by the reversible drive mechanism 132 as it pulls the roof 14 down and fully pivots the ends walls 20 and 22 into the final folded positions shown in FIGS. 10 and 11. Also, the reversible drive mechanism 132 maintains the loadings on the spring segments when the container is in a folded condition.

Figure 14:
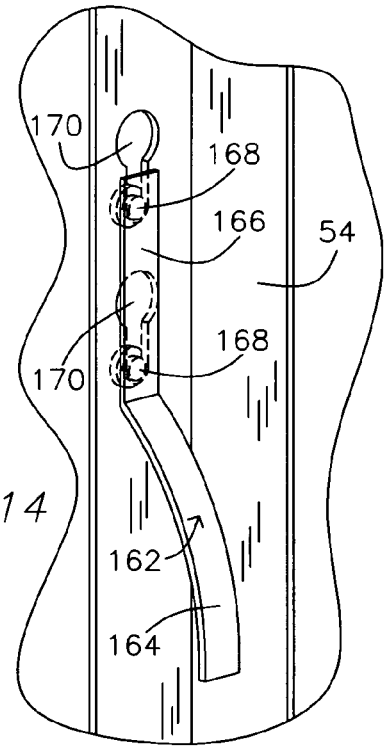
FIG. 14 is a fragmentary sectional view taken along lines 14-14 of FIG. 2 showing an embodiment of spring arrangement utilized for initial vertical displacement of the roof during container unfolding.

One embodiment of a suitable cantilever spring assembly is shown at 162 in FIG. 14 and comprises an elongated and curved leaf spring segment 164 extending from a base 166 that is attached in a vertical orientation to a flange of the angle iron column 54. A similar cantilever spring assembly is placed on each of the four vertical columns 52, 54, 56, and 58 with the curved spring segment on columns 52 and 54 extending towards the curved spring segments on columns 56 and 58 so that as these columns are inwardly folded the ends of the spring segments will bear against the upper surface of folded side wall 18. As the columns are pivoted inwardly by the drive mechanism 132 near the end of the container folding operation the curved leaf spring segments are substantially flattened between the columns and the folded side wall so as to introduce therein a loading or bias which will bear against and columns to assist in the initial pivoting thereof during container unfolding.

In as much as the side walls 16 and 18 can not be pivoted into the container during the folding thereof with the cantilever spring assemblies 162 in place on the columns, the cantilever spring assemblies 162 are attached to the columns after the side walls are folded. A satisfactory easily removable attaching means for this purpose is provided by a bayonet-type coupling wherein capped pins 168 engage keyhole-shaped slots 170 in the flanges of the vertical columns. When the container is unfolded for use the cantilever spring assemblies 162 may be readily stored in any suitable place within or outside of the container 10.

Figure 15:
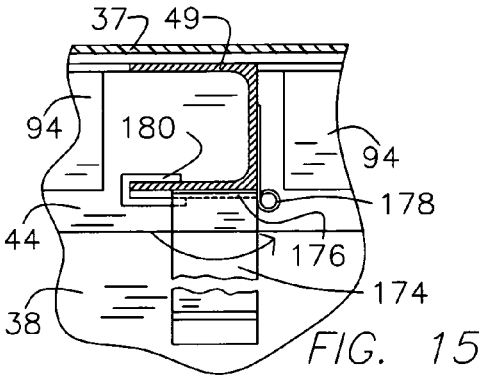
FIG. 15 is a fragmentary sectional view taken along lines 15-15 of FIG. 3 showing another embodiment of spring arrangement for vertically displacing the roof during container unfolding.

A further embodiment of a cantilever spring structure suitable for assisting the drive mechanism 132 in lifting the roof 14 and upwardly tilting the end walls 20 and 22 is shown in FIGS. 9 and 15. In this embodiment a curved elongated leaf spring segment 174 projects from a base portion 176 which is hingedly attached to the roof brace 49. The base portion 176 is attached hinge means 178 to the brace 49 at the interface between vertical and horizontal surfaces thereon with the elongated leaf spring segment being positionable in a plane parallel with the brace 49. The hinge means 178 are of any suitable type but are preferably spring-loaded so that the curved elongated spring segment 174 will rotate about the hinge means 178 into substantially horizontal plane a location adjacent to and underlying the roof 37 when the container is unfolded for its intended use. When the container is to be folded the curved elongated spring segment 174 is rotated about the hinge means 178 to the underside of the brace 49 so that the spring segment 174 will extend in a vertical plane for contact with the upper surface of the folded side wall 18. A simple clip or latch as generally shown at 180 is sufficient to hold the base 176 of the spring segment against the lower surface of the brace 49 during container folding operations.

In this embodiment, like the previously described embodiment of FIG. 14, the bias or roof lifting load is instilled in the spring segment as container folding operation is being completed. At least two such spring structures are preferably supported on the brace 49 so that a substantial amount of lift can be provided by the loaded springs with a distribution of the force exerted by the loaded springs being spread over a relatively large upper surface area of the folded side wall 18. This curved leaf spring segment 174 and the leaf spring segment of the FIG. 14 embodiment are each of a curved length that is sufficient that when biased or loaded by the folding of the container will substantially assist the drive mechanism 132 in lifting the roof 14 for about the first 5 to about 20 vertical inches during container unfolding.

Additionally, as shown in FIGS. 5 and 9, coil springs 184 and 186 are shown placed about the worm gear 134 with the brace 49 and bearing 50 positioned therebetween. These coil springs 184 and 186 will be loaded or compressed by contact with the traveling nut means 136 and 138 as they are driven towards one another by the reversible drive means the during the final stages of the container folding operation. During the container unfolding operation the energy instilled in the compressed coil springs significantly assists the reversible drive means and the cantilever spring assemblies, if used, in the initial angular displacement of the end walls 20 and 22.

Figure 4:
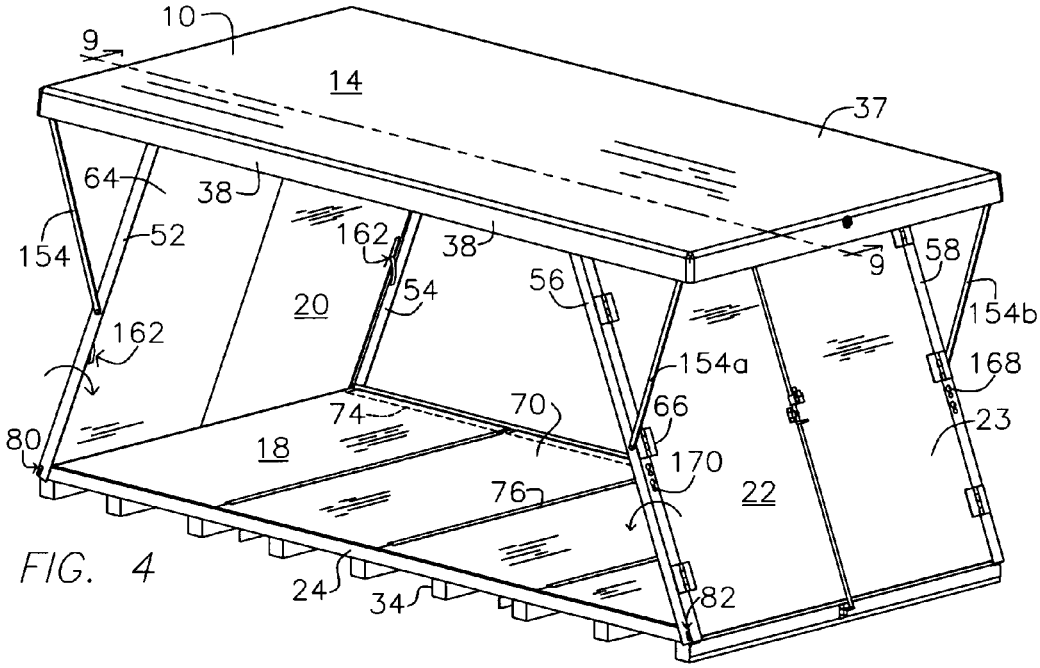
FIG. 4 is a perspective view of the FIG. 1 embodiment illustrating a further stage of container folding wherein the container end walls with the attached roof are being simultaneously folded.

In a typical container folding operation, the side wall panel fastening devices 78 are removed or released. The side walls 16 and 18 are then sequentially folded about the hinges 72 and 74 into stacked parallel positions overlying the floor deck 32 (FIG. 3). If the roof lift assist means of FIG. 14 or FIG. 15 are to be utilized during the container folding operation the cantilever leaf springs are attached to the flanges of the vertical columns (FIG. 14) or rotated into vertically extending positions (FIGS. 9 and 15). The nut-like end 153 of the worm gear 134 is then engaged by a suitable rotating driver and rotated in the desired direction to displace the traveling-nut assemblies 136 and 138 towards one another along the worm gear 134. This displacement of these traveling-nut assemblies 136 and 138 simultaneously pivots the end walls 20 and 22 attached thereto about the hinge means 80 and 82 in a direction towards one another (FIGS. 4 and 9). The roof 14 being attached to the end walls 20 and 22 by the hinged slides 100 and 102 is simultaneously lowered with the pivoting of the end walls 20 and 22. The rotation of the worm gear 134 is continued until the end walls 20 and 22 are positioned end-to-end in a parallel relationship overlying the previously folded side walls 16 and 18 as shown in FIGS. 10 and 11. During the latter stage of this folding operation, the angle iron columns 52 and 54 are sufficiently pivoted though the action of the slotted hinges 80 to overly the vertical flange of the floor railing 28. The end walls 20 and 22 are also moved towards one another by the sliding hinging action of the slotted hinges during late folding stages so as to position the lower ends of the side walls 20 and 22 at a location inwardly spaced from the edges of the floor 12. With the end walls 20 and 22 so positioned, the eaves 38 of the roof cap 37 overlap the underlying folded walls to provide a compact weather-tight and easily transportable container package.

The unfolding of the folded container is accomplished by reversing the above described container folding steps. During the initial container unfolding steps the loaded curved leaf springs 162 or 174 and the coil springs 184 and 186 initially assist the reversible drive means 132 in angularly upwardly displacing the end walls 20 and 22 and lifting the roof 14. With the container unfolded and the fasteners 78 engaged, the resulting container has sufficient structural integrity and is sufficiently weather tight to be satisfactorily used in the envisioned applications.

What is claimed is:

1. A foldable container comprising elongate base means, elongate roof means oriented in a plane substantially parallel to and vertically spaced from said base means, first and second elongate opposing and vertically oriented side wall means disposed between said base means and said roof means, first and second elongate vertically oriented and opposing end wall means disposed between said base means and said roof means and oriented in vertical planes substantially normal to said first and second side wall means, hinge means connecting an end section of each of the first and the second side wall means to said base means for the pivotable sequential displacement of the first side wall means and the second side wall means towards said base means and into folded locations adjacent to and overlying the base means, further hinge means connecting a lower end section of each of the first and second end wall means to said base means for providing rotational axes for the angular displacement of the first and second end wall means in a first direction towards one another during container folding, movable connecting means coupling an upper end section of each of the first and second end wall means to said roof means and movable with respect thereto for the simultaneous angular displacement of the first and second end wall means and the connected roof means in said first direction towards said base means and into substantially parallel locations overlying and adjacent to the first and second side wall means, and reversible drive means supported by said roof means and connected to an upper end section of each of said first and second end wall means for simultaneously angularly displacing the first and second end wall means along said movable connecting means in said first direction.

2. A foldable container as claimed in claim 1, wherein said reversible drive means drive the movable means during container unfolding in a second direction opposite to said first direction for simultaneously angularly displacing the first and second end wall means away from said substantially parallel locations overlying said base means to position the first and second end wall means in said vertical orientation and said roof means in said plane vertically spaced from the base means.

3. A foldable container as claimed in claim 2, wherein each of said first and second end wall means include frame means disposed at peripheral edge regions thereof with first and second side portions of each of said frame means being located adjacent to said first and second side wall means and extending between said base means and said roof means for supporting said roof means and with a third portion of each of said frame means being located adjacent to the roof means and extending between the first and second portions of the frame means, wherein said further hinge means connect a lower end region of each of the first and second portions of said frame means to the base means, and wherein said movable connecting means and said reversible drive means are connected to the third portion of each of said frame means.

4. A foldable container as claimed in claim 3, wherein elongated guide means are supported by said roof means and extend substantially between the first and the second end wall means, wherein the movable connecting means are supported by and movable along said guide means, and wherein said movable connecting means includes additional hinge means connecting each said third portion of said frame means to said guide means for providing the angular displacement of the first and second end wall means while maintaining the connection thereof to said roof means.

5. A foldable container as claimed in claim 4, wherein said roof means has framework means disposed at peripheral edge regions thereof, wherein the elongated guide means are supported by said framework means, and wherein said movable connecting means further includes slide means coupled to said additional hinge means and to said guide means and are movably supported by said guide means for linear displacement thereon.

6. A foldable container as claimed in claim 3, wherein said roof means has framework means disposed at peripheral edge regions thereof with end sections of the framework means disposed adjacent to the third portion of the frame means of each said first and second end wall means, wherein the reversible drive means comprise traveling-nut means disposed between and supported by said end sections of the framework means, and wherein said traveling nut means includes still further hinge means connecting traveling nut means to each end section of the framework means for providing for the angular displacement of the first and second end wall means.

7. A foldable container as claimed in claim 6, wherein said traveling-nut means comprises an elongated externally threaded lead screw mean and internally threaded nut means attached to each of said still further hinge means and threadedly engaging the external threads on said lead screw means, wherein said lead screw means is connected to and rotatably supported by said end sections of the framework means, and wherein each traveling-nut means and opposite end regions of the elongated screw means are directionally threaded for providing said simultaneous angular displacement of the first and second end wall means upon the rotation of the lead screw means in said first and second directions.

8. A foldable container as claimed in claim 7, wherein bearing means are disposed between the end sections of the framework means and the opposite ends of the lead screw means for providing relative rotational movement of the lead screw means with respect to the framework means.

9. A foldable container as claimed in claim 8, wherein one end of said lead screw means extends through one of end sections of the framework means, and wherein coupling means are attached to said one end of the lead screw means for coupling with a lead screw rotating means.

10. A foldable container as claimed in claim 5, wherein the said framework means includes side sections substantially overlying and inwardly spaced from upper end regions of the first and second side wall means, wherein the elongated guide means comprises an elongated substantially u-shaped open-sided channel member attached to each of the side sections of the framework means and extending substantially between the first and second end wall means, wherein a portion of each said slide means is disposed within the u-shaped channel member, and wherein said u-shaped channel has reentrant wall portions at the opening thereinto for supporting the slide means.

11. A foldable container as claimed in claim 10, wherein the reversible drive means is positioned substantially between and parallel with the first and second side wall means.

12. A foldable container as claimed in claim 3, wherein the frame means has corner regions located adjacent to corner regions of said base means, wherein said further hinge means connecting the end region of each of the first and second portions of the frame means to the base means comprise slidable means for the vertical displacement of the first and second end wall means relative to the end regions of the base means during the angular displacement of the first and second end wall means in said first direction for positioning lower end regions of the frame means contiguous to the further hinge means at locations substantially underlying peripheral edge regions of roof means when said first an second end wall means are in said substantially parallel locations.

13. A foldable container as claimed in claim 12, wherein said base means includes elongated upright flange means disposed along side regions thereof adjacent to each of said first and second side wall means and with end portions of each upright flange means being located in each corner region of the base means, wherein said slidable means comprises substantially vertically oriented elongated slots located in the lower end regions of the first and second portions of the frame means and pin means projecting from the end portions of said upright flange means and engaging the slot means, and wherein the movable connecting means displace the frame means relative to the end regions of the base means by moving the slotted frame means relative to the pin means during the angular displacement of the first and second end wall means.

14. A foldable container as claimed in claim 3, wherein said base means includes further upright flange means disposed at a location substantially parallel to and inwardly spaced from one of said first and second end wall means with upper end regions of end portions on said further flange means substantially underlying and outwardly spaced from said pin means, wherein said further upright flange means abuts against and supports the frame means of said one of the first and second end wall means when the latter are vertically oriented, and wherein the displacing of the frame means relative to the base means provides for the positioning of said one end wall means at a location overlying the further upright flange means when said first and second end wall means are in said parallel locations.

15. A foldable container as claimed in claim 3, wherein the first and second end wall means comprises at least one end panel means attached at peripheral edge regions thereof to the frame means of each of the first and second end wall means, wherein the first and second side wall means comprise at least one side panel means having peripheral edge regions disposed contiguous to said base means and said roof means and to said frame means of each of the first and second end wall means, and wherein selectively engagable fastening means attach the at least one side panel means to the roof means and frame means of each of the first and second end wall means.

16. A foldable container as claimed in claim 15, wherein said at least one side panel means comprises a plurality of rectangular panels disposed in a side-by-side relationship, and wherein adjacent panels are secured together by selectively engagable fastening means.

17. A foldable container as claimed in claim 3, including stabilizing means for maintaining the roof means in a plane substantially parallel with said base means during the displacement of the first and second end wall means in said first and said second direction.

18. A foldable container as claimed in claim 3, including means for assisting said reversible drive means in the initial angular separation of said first and second end wall means away from said substantially parallel locations overlying the base means and in said second direction during container unfolding.

19. A foldable container as claimed in claim 18, wherein said means for assisting the initial separation of said first and second end wall means separation of said first and second end wall means away from said substantially parallel locations overlying the base means during container unfolding comprise spring means located intermediate an upper surface on one of the folded first and second side wall means and one of said roof means and said end wall means, and wherein said spring means bear against said upper surface of one of the folded side wall means and one of said roof means and said end wall means during the displacement of the end wall means in said first direction by said reversible drive means for loading said spring means with sufficient energy for the assisting of the reversible drive means in said initial angular separation of said first and second end wall means.

20. A foldable container as claimed in claim 8, including coil spring means disposed about said lead screw means and compressible during final stages of the angular displacement of the end wall means in said first direction, and wherein the compressed coil springs means bear against the first and second end wall and assist the reversible drive means in displacing the first and second end wall mean is said second direction.

* * * * *